US010953965B1

(12) United States Patent
Levy

(10) Patent No.: US 10,953,965 B1
(45) Date of Patent: Mar. 23, 2021

(54) WATER SAFETY GARMENT WITH INTEGRATED RUDDER

(71) Applicant: Peter L. Levy, San Francisco, CA (US)

(72) Inventor: Peter L. Levy, San Francisco, CA (US)

( * ) Notice: Subject to any disclaimer, the term of this patent is extended or adjusted under 35 U.S.C. 154(b) by 0 days.

(21) Appl. No.: 16/992,112

(22) Filed: Aug. 13, 2020

(51) Int. Cl.
*B63C 9/125* (2006.01)
*B63C 9/08* (2006.01)
*B63H 25/38* (2006.01)

(52) U.S. Cl.
CPC ..... *B63C 9/1255* (2013.01); *B63C 9/08* (2013.01); *B63H 25/38* (2013.01)

(58) Field of Classification Search
CPC .. B63C 9/00; B63C 9/08; B63C 9/125; B63C 9/1255; B63H 25/00; B63H 25/38
USPC ..... 441/55, 88, 94, 106, 108
See application file for complete search history.

(56) References Cited

U.S. PATENT DOCUMENTS

D667,911 S * 9/2012 Barbis ..... D21/805
8,262,426 B1 * 9/2012 Barbis ..... B63C 9/08 441/88

* cited by examiner

*Primary Examiner* — Lars A Olson
(74) *Attorney, Agent, or Firm* — Patent Alchemy

(57) ABSTRACT

A life-jacket with an integrated rudder for navigating water currents is shown. The jacket integrated rudder is for water navigation in swift currents and is of simple construction, using a cord with handles to steer the attached rudder by pull of cord attached handles side-to-side.

10 Claims, 4 Drawing Sheets

WATER SAFETY GARMENT WITH INTEGRATED RUDDER

BACKGROUND

Field of the Invention

The present invention relates generally to water safety devices and particularly to an integrated rudder life-jacket useful in navigating currents while maintaining buoyancy.

Background of the Invention

Running or swimming a rapid flowing stream or river can be challenging for even the strongest swimmers. Getting flipped off a raft or floatation device often happens and the survival strategy is to to roll yourself back upright and swim to safety. Unfortunately this doesn't translate in many cases, especially down swift moving and bump rapids.

Getting flipped over in moving water will fool even the best survival instincts because we generally train in flat water, and suddenly rapids are a merciless time to retrain instincts.

When going of to the side into the rapidly flowing water, maneuvering into a breathable position can be challenging. Having accomplished that then moving to a safe position like shore or boat will require a strong swim into and against currents. A human is ill equipped to beat the onslaught of a raging flooding river or rapid.

What is needed are safety devices for the reluctant or surprised swimmers to retain control in the rapidly moving waters and allow swimmer to swiftly move to safety, even when there is insufficient swimmer strength to reach safety.

Swimming where rivers are flooding, wood and rocks are moving past, every watery section running strong current is the time to be extremely careful as precious life may be on the line and a bad decision may cost. This is where self-rescue swimming and survival swimming becomes mandatory. What is needed are water devices which are just part and parcel with the activities around and in dangerous waters, devices that can save a life.

Life-jackets have been in use and are generally made of various water-proof materials such as nylon and other synthetics. These may be inflatable or floatable when filled with compressed air or floatation material, Styrofoam or other materials used to increase their buoyancy, respectively. Quite often they were designed for emergencies and have the disadvantage of being uncomfortable to wear and not sufficiently warm.

In teaching rapids or river swimming to beginners, or for swimmers who are somewhat handicapped, it is desirable to provide additional safety margins. Affixing devices to typical life-jacket construction, whether formed of padded fibrous filled materials or buoyant plastic materials, generally are of a size and shape which interfere with swimming motions, additional floatation where limited area of the body and are inadequate for the purposes of generally supporting the torso is needed. Moreover where the life-jacket impedes the swimmer, an alternate device to get a swimmer caught in rapid currents is welcome.

What are needed are water garment affixable-removable devices to support a swimmer in the water currents without interfering with the movements of the swimmer's limbs and the shoulder and leg muscles and also provides minimum bulging or interference with the general shape of the swimmer's body.

Many conventional personal floatation devices are ill equipped for supporting users in positions that maintain the swimmers head above raging or rapidly flowing water, even when the remainder of the body can be submerged. Many personal floatation devices are designed to support the user in a vertical orientation (i.e. with the head up and feet down), such devices are not useful applications where a heads horizontal orientation is desired. Of those devices capable of orienting the user in both an upright and horizontal position along the surface of the water, some such devices tend to be cumbersome to use, making such devices less suitable for use in emergency conditions. Furthermore, the safety-jacket may lack the ability to automatically orient the individual in a particular direction within a moving body of water, forcing a swimmer to exert energy to maintain their bearing within the water while swimming hard against the current to get to safety. What is needed are water safety devices that can maintain a swimmers head above water in a navigable orientation suitable for rescue or self-rescue.

SUMMARY

The present invention discloses a water safety garment or life jacket with an integrated rudder. Such a life-jacket has a dorsal fin-like rudder with rudder base integrated edge hinge coupled to the jacket back side and the rudder with a supporting frame flexibly protruding from the jacket back side edge. A flexible cord having two ends, with cord middle firmly attached to the rudder for lateral rudder controls using the pull handles at each cord end, with cord threaded through a jacket lateral side loops and midway attached to the rudder for lateral rudder side to side. A swimmer floating in a water current in such a life-jacket with integrated rudder can navigate position via pull handle steering by pulling the cord attached to the backside protruding rudder. The rudder and rudder panel material is for water environment and made from a set of light weight water-displacing materials such as nylon, foam, plastic, Styrofoam and synthetics.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

An object of the invention is to provide a life jacket effective in navigating water currents too strong to swim out of.

Another object of the present invention is to provide a safety increasing device for a water garment such as a life-jacket which is suitable to wear when enjoying offshore fishing, boating, recreating, running rapids or just escaping a flooding river.

It is another object of the present invention to increase the margin of safety for a life-jacket having a rudder enabling a swimmer with instant control over watery immersion navigation without the need for more power, which the swimmer may or may not have sufficient to handle in an emergency situation It is another object of the present invention to provide a safety boosting life-jacket device with added buoyancy.

It is another object of the present invention to provide a life-jacket safety add-on which can be foldably affixed to the wearer's body using any swimming garment, even those not in the life-jacket class.

The present invention discloses several embodiments for a life jacket with a rudder.

Figure 1:
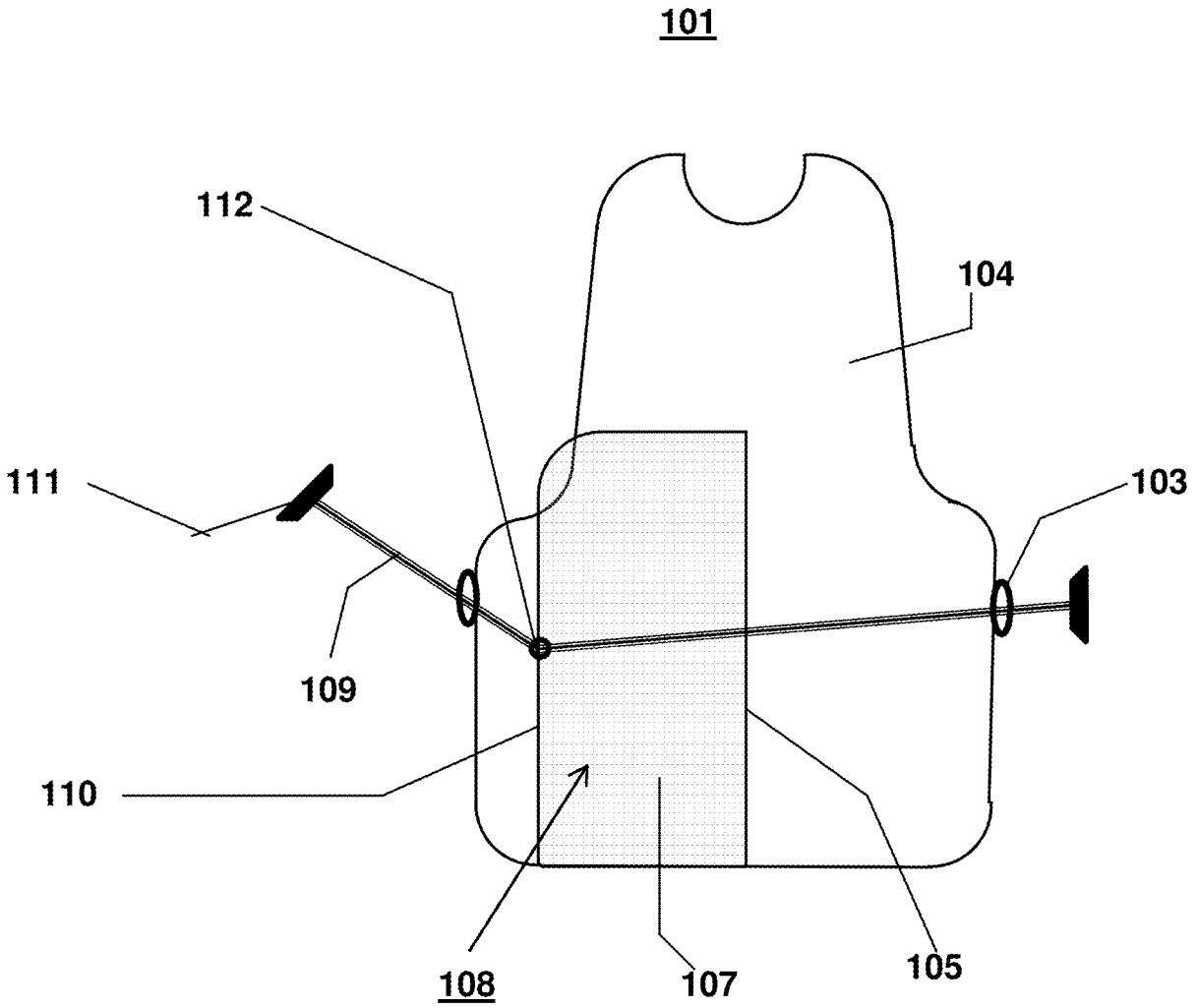
FIG. 1 illustrates a life jacket with an integrated rudder with hand controls in an embodiment of the invention

FIG. 1 illustrates a life jacket with an integrated rudder with hand controls in an embodiment of the invention. A life-jacket water safety garment with an integrated rudder is a preferred embodiment of the invention although other water wear are equally applicable. A life jacket 101 and a dorsal fin-like rudder 108 base integrated edge hinge 105 coupled to the jacket back side 104 are shown for a preferred embodiment. The rudder 108 having a supporting frame body 110 provides flexible rigidity support from inside the outer rudder cover, with rudder flexibly protruding from the jacket back side 104 edge 105 with freedom to pivot from side to side. A flexible cord 109 having two ends, with the cord middle 109 firmly attached 112 to the rudder 108 for controlling rudder angle. Each cord end has a pull handle 111 for manual control with the cord threaded through a jacket 103 lateral side loop 103 and midway attached to the rudder 112 for lateral rudder control via the pull handles 111. A swimmer with life-jacket integrated rudder can navigate via pull handle 111 steering the floater by pulling the cord attached to the backside protruding rudder.

Figure 2:
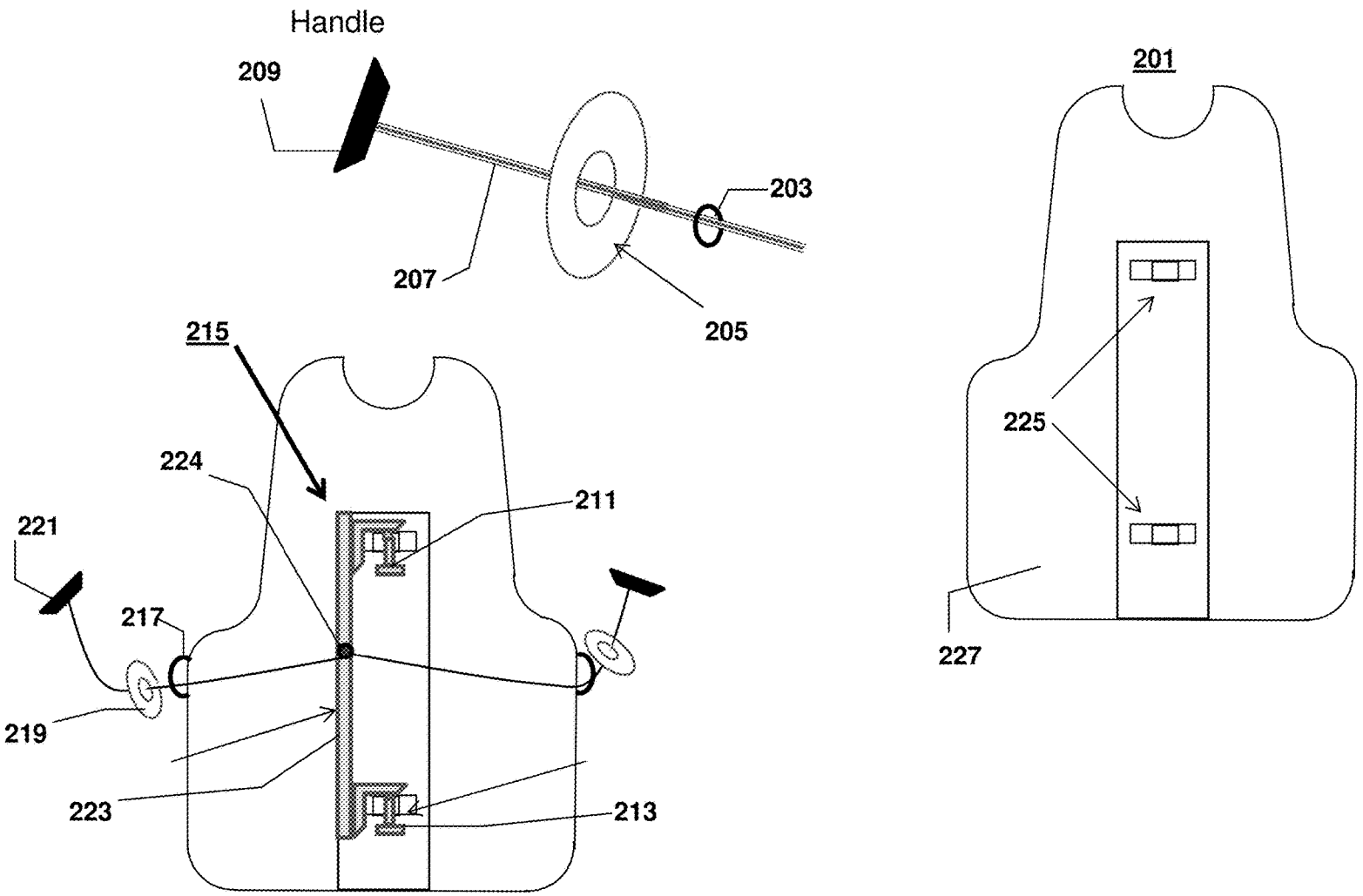
FIG. 2 shows a life jacket with an integrated rudder with hand controls in an embodiment of the invention.

FIG. 2 shows a life jacket with an integrated rudder with hand controls in an embodiment of the invention.

The back side of a typical life-jacket 227 with integrated attachable-detachable rudder is shown with a added support patch 225 coupling a rudder 215 base centerline edge 223 with attachable-detachable hinge locks 211 213 at the two base edge 223 ends. Hook-and-loop or snap-on components can be used as well to attach and detach the rudder from the jacket back. The rudder integration patch 225 or guard can be hook-and-loop, or more permanently coupled to a life jacket 210 with adhesives or stitching in other embodiments. Patch material should be compatible with life jacket 201. The rudder internals can be with waterproof or water compatible material casing for inflatable or synthetic foam or semi-rigid material in panels or compartments. These would be shaped as narrow slab volumes or compartments for fluid redirecting strength. Redirection would come from the manipulation of cord 207 handles 209 221. The cord is threaded thru jacket loops 203 217 and loop guards 205 219 and is affixed to the rudder 215 centerline 223, providing the handles 209 221 with rudder control for steering in a water current.

Figure 3:
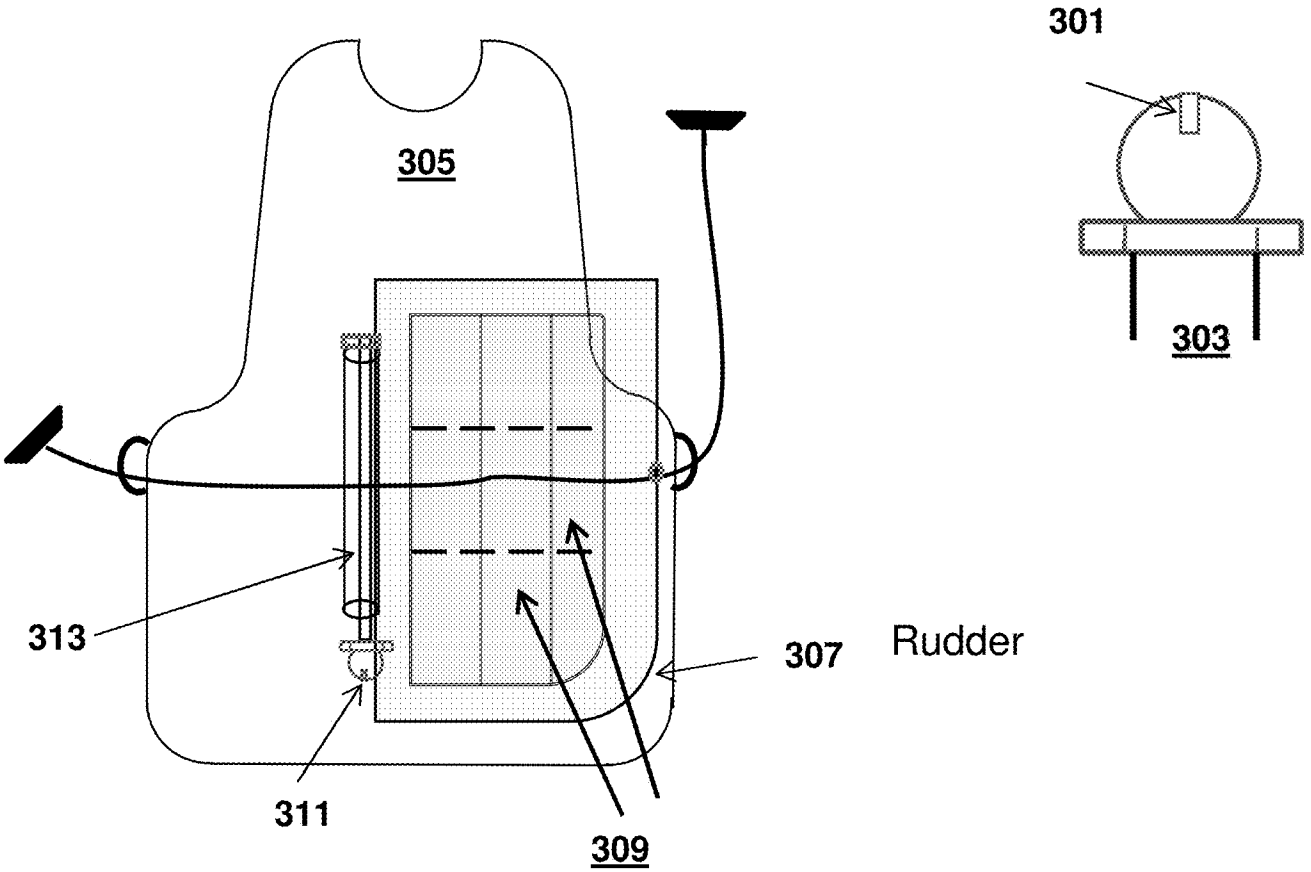
FIG. 3 illustrates a embodiment for a manual control life jacket integrated attachable-removable rudder.

FIG. 3 illustrates a embodiment for a manual control life jacket integrated attachable-removable rudder. A backside life-jacket 305 is shown with an integrated attachable-detachable rudder 307. A rudder base edge 313 is shown hinge coupled to the life-jacket 305 from top to down backside in vertical alignment as worn with a rudder base edge. The rudder 307 has an outer casing with supporting frame body panel(s) 309 inside the casing to add stiffness to the rudder with water weight neutral or buoyant material(s). The rudder base edge 313 or jacket rudder hinge coupling 313 has a fiber shaft insert or centerline loop for a fiber rod extended to the loop outside with a lock-nut fastener 303 311 with head slot 301 or snap on fasteners providing easy engagement of rudder 307 attachment or detachment to/from jacket back 305 respectively at a hinge coupled rudder edge 311. Rudder panel 309 materials can be compressed air-pockets or Styrofoam-like light and stiff buoyant water non-absorbing material.

In an embodiment of the invention the rudder panel material is made from a set of light weight water-displacing materials such as nylon, foam, plastic, styrofoam and synthetics. In another embodiment the integrated rudder panels will be inflatable compartments floatable when filled with compressed air to provide stiffness to rudder plane and to increase jacket buoyancy. In other embodiments a jacket rudder hinge coupling will have fiber shaft insert in centerline loop in casing or a fiber rod end terminated with a lock-nut fastener or snap on fasteners. In still other embodiments of the invention a rudder 307 could be attached to a life-jacket with snaps or snap on device, hook-and-loop, adhesives, stitched on reinforcements or sewn. In another embodiment a bar that is attached to rudder and part of rod, flattened for the inside, could slip over top of a life-jacket and be held in place by the pressure of the wearer's body and material flexible strap secured.

Figure 4:
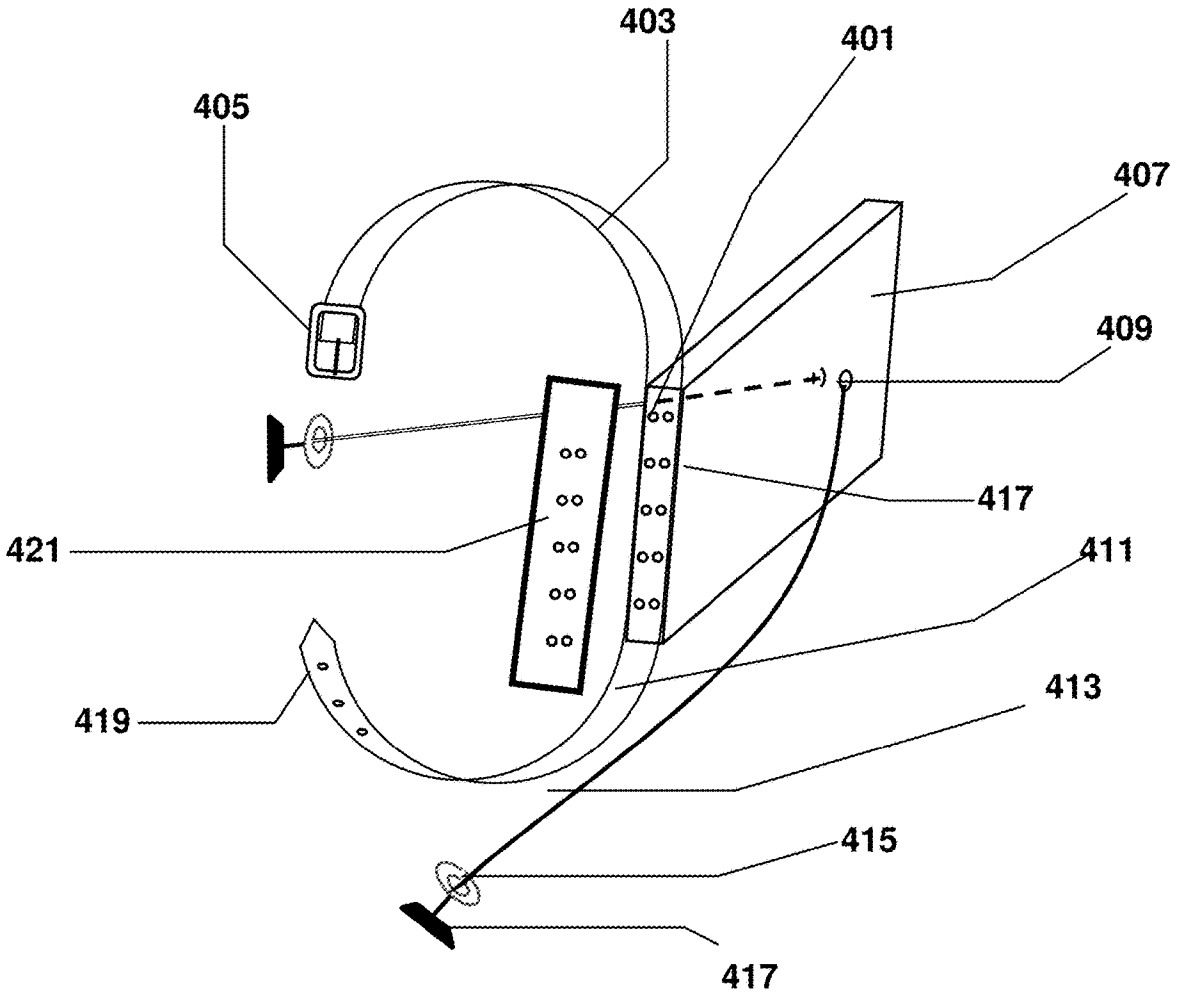
FIG. 4 shows an embodiment for a manual control life jacket attachable-removable rudder 407.

FIG. 4 shows an embodiment for a manual control life jacket attachable-removable rudder 407. A coupling patch 421 to be affixed to a life-jacket backside is shown separate from a rudder 407. A rudder base edge 417 is hinge coupled to the life-jacket patch 421 from top to down backside in vertical alignment as worn. In an embodiment hinge coupling can be made with snaps 401, hook-and-loop, sewn or stitched, adhesives or combinations. In some embodiments the rudder 407 has an outer casing with a flexible supporting body panel(s) 407 inside the casing to add stiffness to the rudder 407 with water weight neutral or buoyant material(s). The rudder base edge 417 or jacket rudder hinge coupling 417 421 can have material re-enforcement patches for added rudder hinge coupling strength, thru adding snap fasteners, hook-and-loop or other snap-on fasteners providing easy engagement of rudder 407 attachment or detachment to/from jacket back coupling patch 421 respectively. In other embodiments the patch reinforcing coupling 421 can be an extended flexible strap 411 403 extending around the life-jacket connecting both ends 405 419 with a belt, hook-and-loop or snap-on fasteners, or other strap coupling. The rudder panel 407 materials can be compressed air-pockets or Styrofoam-like light-weight and stiff buoyant water non-absorbing material.

A flexible cord 413 having two ends, with the cord middle 409 firmly attached to the rudder 407 is used for controlling rudder angle. Each cord end has a pull handle 417 for manual control with the cord threaded through a jacket 415 lateral side loop 103 and midway attached to the rudder 409 for lateral rudder control via the pull handles 417.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A water safety garment with an integrated rudder comprising:

a jacket and a dorsal fin-like rudder base edge hinge coupled to a jacket back side;

the rudder having a semi-flexible frame body protruding from a jacket back side edge;

a cord having two ends, with cord middle firmly attached to the rudder, and each cord end having a pull handle with cord threaded through jacket lateral side loops and midway affixed to the rudder for rudder control via the pull handles whereby wearer floating in a water current in jacket with integrated rudder can navigate via pull handle steering by pulling the cord attached to the backside protruding rudder.

2. A water safety garment with an integrated rudder as in claim 1 further comprising rudder frame body panel material from a set of water weight neutral or buoyant water-displacing materials from a group of materials including nylon, foam, plastic and synthetics.

3. A water safety garment with an integrated rudder as in claim 1 further comprising frame body of panels from be inflatable compartments floatable when filled with compressed air to provide stiffness to rudder plane and to increase jacket buoyancy.

4. A water safety garment with an integrated rudder as in claim 1 further comprising jacket to rudder hinge coupling using hook-and-loop or snap-on attachment.

5. A water safety garment with an integrated rudder as in claim 1 further comprising jacket rudder hinge coupling having fiber shaft insert in centerline loop or a fiber rod end terminated with a lock-nut fastener or snap on fasteners for rudder attachment-detachment from jacket.

6. A method for a water safety garment with an integrated rudder comprising the steps of:

hinge coupling a dorsal fin-like rudder at base edge to a jacket back side;

providing a rudder flexibly protruding from a jacket back side edge;

providing a cord having two ends, with cord middle firmly attached to the rudder, and providing pull handles on each cord end, cord threaded through a jacket lateral side loop and midway attached to the rudder for lateral rudder control via the pull handles whereby wearer floating in a water current in jacket with integrated rudder can navigate via pull handle steering by pulling the cord attached to the backside protruding rudder.

7. A method for a water safety garment with an integrated rudder as in claim 6 further comprising the steps of using rudder panel material from a set of water weight neutral or buoyant water-displacing materials from a group of materials including nylon, foam, plastic, and synthetics.

8. A method for a water safety garment with an integrated rudder as in claim 6 further comprising the steps of providing panels with inflatable compartments floatable when filled with compressed air to provide stiffness to rudder plane and to increase jacket buoyancy.

9. A method for a water safety garment with an integrated rudder as in claim 6 further comprising the steps of providing jacket rudder hinge coupling having fiber shaft insert in centerline loop or a fiber rod end terminated with a lock-nut fastener or snap on fasteners for rudder attachment-detachment from jacket.

10. A method for a water safety garment with an integrated rudder as in claim 6 further comprising the steps of providing a jacket to rudder hinge coupling using hook-and-loop or snap-on attachment.

* * * * *